US009385460B2

(12) United States Patent
Shinohara

(10) Patent No.: US 9,385,460 B2
(45) Date of Patent: Jul. 5, 2016

(54) CONNECTOR

(71) Applicant: YAZAKI CORPORATION, Minato-ku, Tokyo (JP)

(72) Inventor: Junya Shinohara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/479,672

(22) Filed: Sep. 8, 2014

(65) Prior Publication Data

US 2014/0378005 A1 Dec. 25, 2014

Related U.S. Application Data

(63) Continuation of application No. PCT/JP2013/052543, filed on Feb. 5, 2013.

(30) Foreign Application Priority Data

Mar. 9, 2012 (JP) ..... 2012-052929

(51) Int. Cl.
*H01R 13/08* (2006.01)
*H01R 13/422* (2006.01)
(Continued)

(52) U.S. Cl.
CPC ..... *H01R 13/08* (2013.01); *H01R 13/4223* (2013.01); *H01R 13/502* (2013.01); *H01R 24/60* (2013.01); *H01R 13/4361* (2013.01); *H01R 2107/00* (2013.01)

(58) Field of Classification Search
CPC ..... H01R 13/4223; H01R 13/4365; H01R 13/4361
See application file for complete search history.

(56) References Cited

U.S. PATENT DOCUMENTS 4,045,110 A * 8/1977 Sterken ..... H01R 13/436 439/345
4,973,268 A * 11/1990 Smith ..... H01R 13/443 439/589

(Continued)

FOREIGN PATENT DOCUMENTS

JP 2003-257531 A 9/2003
JP 2004-119088 A 4/2004

(Continued)

OTHER PUBLICATIONS

Japanese office action letter issued on Oct. 13, 2015 in the counterpart Japanese patent application the extended European search report issued on Sep. 23, 2015 in the counterpart European patent application.

(Continued)

*Primary Examiner* — Gary Paumen
(74) *Attorney, Agent, or Firm* — MOTS Law, PLLC

(57) ABSTRACT

A connector includes a connector housing provided with multiple terminal housing chambers. The multiple terminal housing chambers are separated by top walls, bottom walls, and side walls. Lances are supported by the bottom walls of the terminal housing chambers, which are located on the same surface side. Each of the bottom walls includes a cutout portion which avoids interference with the lance when the lance bends in a direction to retreat from the terminal housing chamber. Each lance bends in the direction to retreat from the terminal housing chamber when a terminal is inserted into the terminal housing chamber. When the terminal is fully inserted into a regular insertion position, each lance recovers from flexural deformation and is locked to the terminal.

18 Claims, 4 Drawing Sheets

(51) Int. Cl.

| | |
|---|---|
| ***H01R 13/502*** | (2006.01) |
| ***H01R 24/60*** | (2011.01) |
| *H01R 107/00* | (2006.01) |
| *H01R 13/436* | (2006.01) |

(56) References Cited

U.S. PATENT DOCUMENTS

| | | | | | |
|---|---|---|---|---|---|
| 5,009,615 | A * | 4/1991 | Mobley | H01R 13/4223 | 439/594 |
| 5,044,991 | A * | 9/1991 | Colleran | H01R 13/5221 | 439/274 |
| 5,122,080 | A * | 6/1992 | Hatagishi | H01R 13/4362 | 439/595 |
| 5,211,586 | A * | 5/1993 | Maue | H05K 5/0069 | 439/695 |
| 5,403,211 | A * | 4/1995 | Sayer | H01R 13/4362 | 439/603 |
| 5,830,013 | A * | 11/1998 | Saito | H01R 13/4362 | 439/595 |
| 5,964,621 | A * | 10/1999 | Wolla | H01R 13/4364 | 439/595 |
| 5,989,066 | A * | 11/1999 | Cox | H01R 13/4365 | 439/595 |
| 6,068,512 | A * | 5/2000 | Sugie | H01R 13/4368 | 439/595 |
| 6,149,462 | A * | 11/2000 | Sugie | H01R 13/4368 | 439/595 |
| 6,296,531 | B1 * | 10/2001 | Nagamine | H01R 13/4362 | 439/595 |
| 6,332,803 | B1 * | 12/2001 | Matsuda | H01R 13/4223 | 439/488 |
| 6,851,977 | B2 * | 2/2005 | Tsuji | H01R 13/4223 | 439/595 |
| 7,303,437 | B2 * | 12/2007 | Nishide | H01R 13/447 | 439/595 |
| 8,113,881 | B2 * | 2/2012 | Sakamoto | H01R 13/4223 | 439/595 |
| 8,251,743 | B2 * | 8/2012 | Sakamoto | H01R 13/4362 | 439/595 |
| 8,651,901 | B2 * | 2/2014 | Beck, Jr. | H01R 13/4365 | 439/595 |
| 8,721,375 | B2 * | 5/2014 | Hori | H01R 13/4362 | 439/752 |
| 8,747,156 | B2 * | 6/2014 | Hirabayashi | H01R 13/113 | 439/595 |
| 2003/0068930 | A1 * | 4/2003 | Endo | H01R 13/4362 | 439/752 |
| 2003/0087563 | A1 * | 5/2003 | Endo | H01R 13/4362 | 439/752 |
| 2003/0207616 | A1 * | 11/2003 | Nishide | H01R 13/4365 | 439/595 |
| 2005/0085127 | A1 * | 4/2005 | Maeda | H01R 13/4365 | 439/595 |
| 2005/0124216 | A1 * | 6/2005 | Sagawa | H01R 13/4365 | 439/595 |
| 2005/0250385 | A1 * | 11/2005 | Tsuji | H01R 13/4365 | 439/595 |
| 2006/0281373 | A1 * | 12/2006 | Anbo | H01R 13/4367 | 439/752 |
| 2007/0066135 | A1 * | 3/2007 | Menez | H01R 13/4226 | 439/595 |
| 2007/0281555 | A1 | 12/2007 | Suemitsu et al. | | |
| 2009/0191747 | A1 * | 7/2009 | Tanaka | H01R 13/4365 | 439/352 |

FOREIGN PATENT DOCUMENTS

| | | | |
|---|---|---|---|
| JP | 2005-216810 | A | 8/2005 |
| JP | 2007-012352 | A | 1/2007 |
| JP | 2007-324049 | A | 12/2007 |
| JP | 2009-181721 | A | 8/2009 |
| JP | 2011-071061 | A | 4/2011 |
| JP | 2013-187126 | A | 9/2013 |
| WO | 2012-029351 | A1 | 3/2012 |

OTHER PUBLICATIONS

Japanese office action letter issued on Dec. 16, 2015 in the counterpart Japanese patent application.

* cited by examiner

CONNECTOR

CROSS REFERENCE TO RELATED APPLICATIONS

This application is a continuation application of International Application No. PCT/JP2013/052543, filed on Feb. 5, 2013, which claims priority to Japanese Patent Application No. 2012-052929, filed on Mar. 9, 2012, the entire contents of which are incorporated by references herein.

BACKGROUND OF THE INVENTION

1. Field of the Invention

The present invention relates to a connector including multiple terminal housing chambers and configured to position a terminal inserted into each terminal housing chamber by using a lance.

2. Description of the Related Art

FIG. 1 shows a connector 50 disclosed in Japanese Patent Application Laid-Open Publication No. 2011-71061. The connector 50 includes a connector housing 51 formed by uniting an inner housing and an outer housing. The connector housing 51 is provided with multiple terminal housing chambers 52 and multiple terminal housing chambers 53 arranged in a horizontal direction on two upper and lower stages. Each pair of the terminal housing chambers 52 and 53 on the upper and lower stages are separated by a partition wall 54. The partition wall 54 is provided with two lances 55 and 56 which correspond to the terminal housing chambers 52 and 53 on the upper and lower stages, respectively. Each of the lances 55 and 56 is supported in a cantilever fashion by the partition wall 54. The lance 55 on the upper stage side projects into the upper-stage terminal housing chamber 52, and the lance 56 on the lower stage side projects into the lower-stage terminal housing chamber 53. In other words, the lance 55 is located on a lower side in the upper-stage terminal housing chamber 52, and the lance 56 is located on an upper side in the lower-stage terminal housing chamber 53.

In the above-described configuration, when terminals 60 are inserted into the terminal housing chambers 52 and 53, the lances 55 and 56 are flexurally deformed in such directions to retreat from the terminal housing chambers 52 and 53, thereby allowing insertion of the terminals 60. When the terminals 60 are fully inserted into regular insertion positions, the lances 55 and 56 recover from the flexural deformation and are locked to the terminals 60. The terminals 60 are kept from moving in a direction reverse to the insertion direction (a direction to pull out the terminals) by the lances 55 and 56, and are thus positioned.

In the conventional example described above, the lance 55 on the upper stage side and the lance 56 on the lower stage side are arranged back-to-back, thereby sharing a flexural deformation region S. This makes it possible to reduce a pitch between the terminal housing chambers 52 and 53 on the two upper and lower stages and to downsize the connector 50.

SUMMARY OF THE INVENTION

However, in the conventional example, the lance 55 is disposed on a bottom surface side in the upper-stage terminal housing chamber 52 and the lance 56 is disposed on a top surface side in the lower-stage terminal housing chamber 53. For this reason, the orientation of the terminals 60 to be inserted into the upper terminal housing chambers 52 and the orientation of the terminals 60 to be inserted into the lower terminal housing chambers 53 have to be vertically inverted.

If the orientations of insertion of the terminals 60 are not all the same as mentioned above, such discordance leads to an increase in the number of procedures for terminal insertion when the terminal insertion is automated.

On the other hand, when the orientations of insertion of the terminals 60 are the same, the lances 55 and 56 cannot share the flexural deformation region S. As a consequence, the reduction in the pitch between the terminal housing chambers 52 and 53 is affected and the connector 50 increases its size.

In view of the above, it is an object of the present invention to provide a connector, which can achieve a reduction in size without increasing the number of procedures for terminal insertion.

An aspect of the present invention is a connector. The connector includes: a connector housing including a plurality of terminal housing chambers on a plurality of stages; and lances each being supported by a wall of the corresponding terminal housing chamber, projecting into the terminal housing chamber, and being configured to bend in a direction to retreat from the terminal housing chamber when a terminal is inserted into the terminal housing chamber and to recover from flexural deformation when the terminal is fully inserted into a regular insertion position. The lances are supported by the walls of the terminal housing chambers, which are located on the same surface side. The terminal housing chambers on one of the stages and the terminal housing chambers on a stage adjacent to the one of the stages are arranged in such a way as to be shifted from one another. Each of the walls includes a cutout portion configured to avoid interference with the corresponding lance when the lance bends in the direction to retreat from the terminal housing chamber.

The connector housing may include a lance installation opening, and the lances are provided to a lance block body to be attached into the lance installation opening.

According to the present invention, the lances are respectively supported by the walls in the same orientation in the terminal housing chambers. As a consequence, the orientations of insertion of the terminals become the same, and the number of procedures for terminal insertion is not increased when the terminal insertion is automated. Since a flexural deformation region for each lance is secured by use of the cutout portion of the wall, a clearance corresponding to the flexural deformation of the lance does not have to be secured between the lance and the wall. Accordingly, it is possible to reduce the pitch between the terminal housing chambers and to achieve reduction in size of the connector. Thus, the connector can be downsized without increasing the number of procedures for the terminal insertion.

DESCRIPTION OF THE PREFERRED EMBODIMENTS

An embodiment of the present invention will be described below with reference to the drawings.

Figure 1:
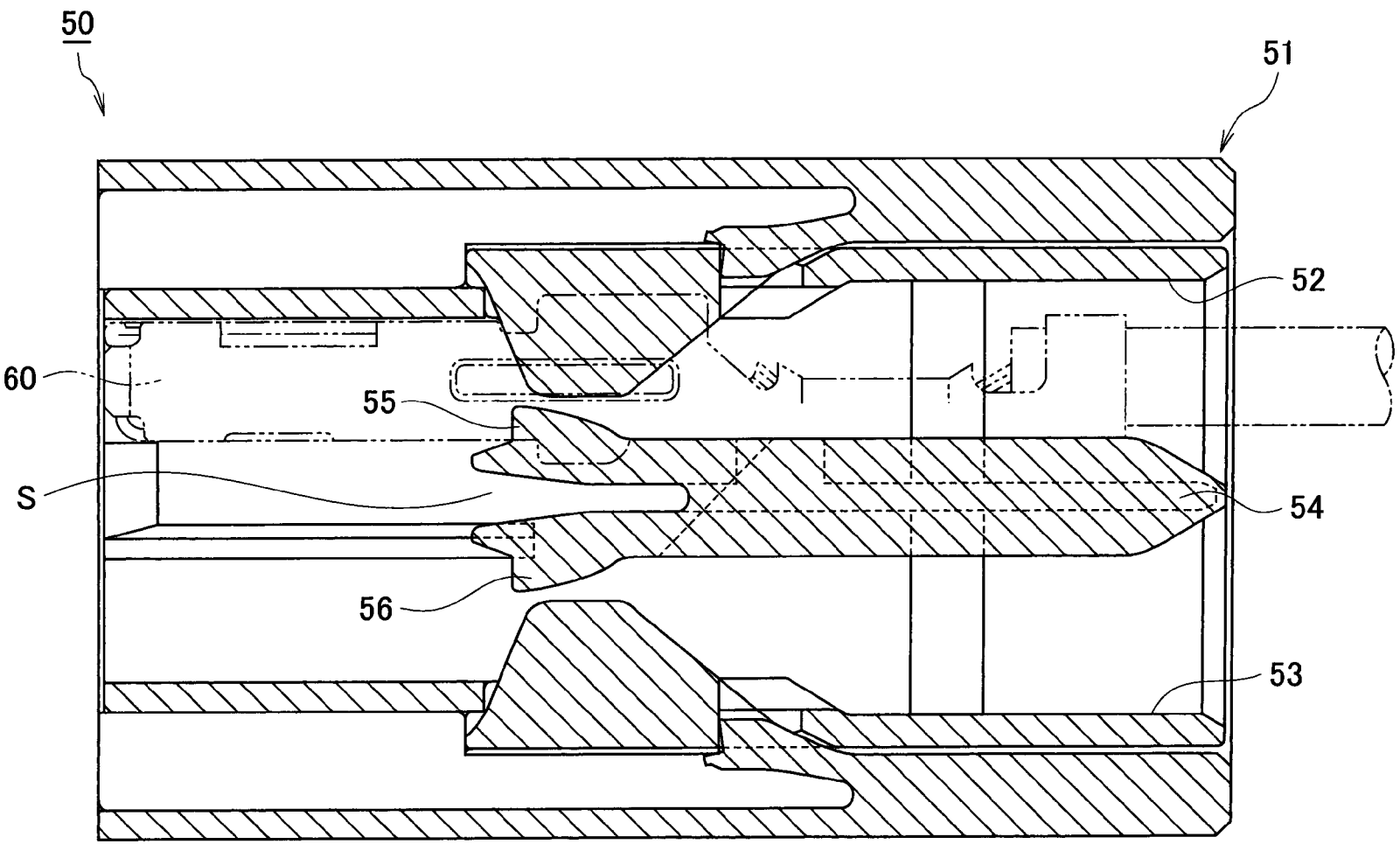
FIG. 1 is a cross-sectional view of part of a connector according to a conventional example.
Figure 2:
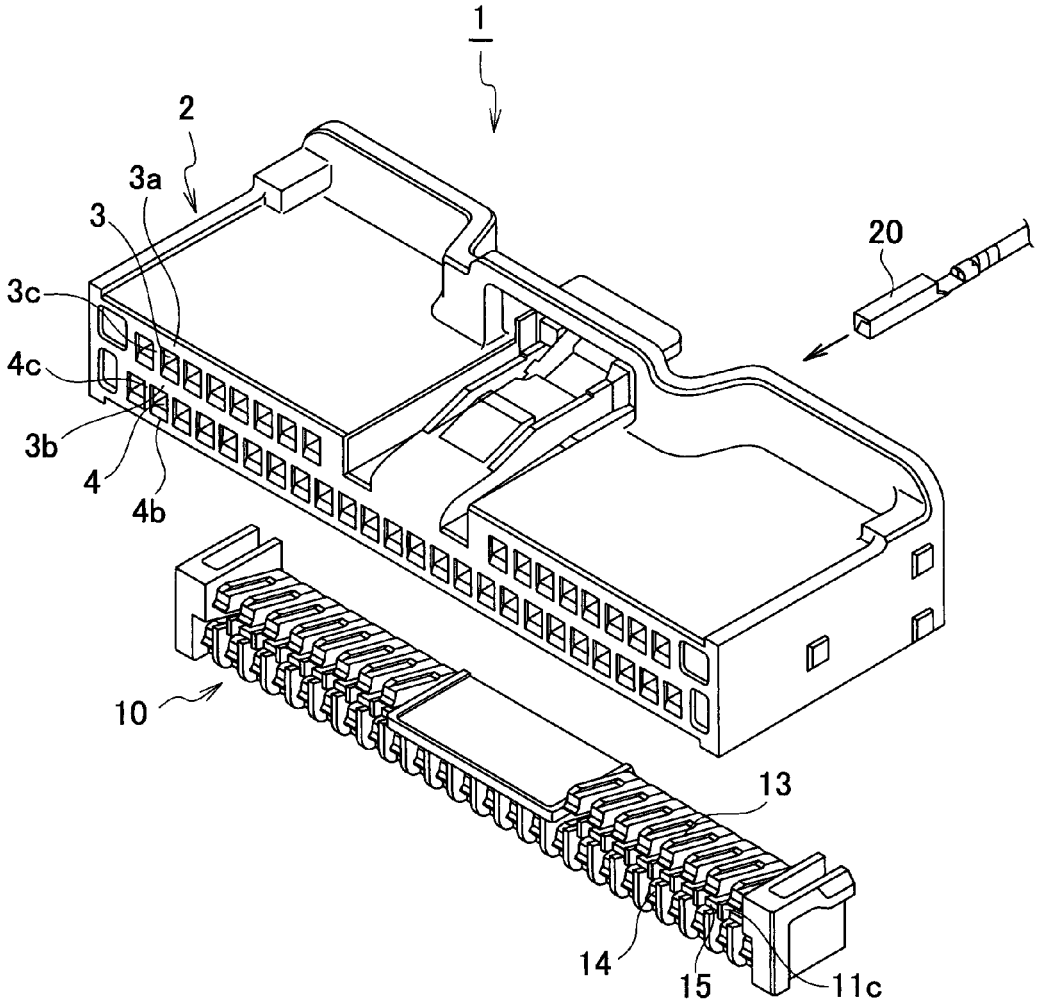
FIG. 2 is an exploded perspective view of a connector according to an embodiment of the present invention.
Figure 3:
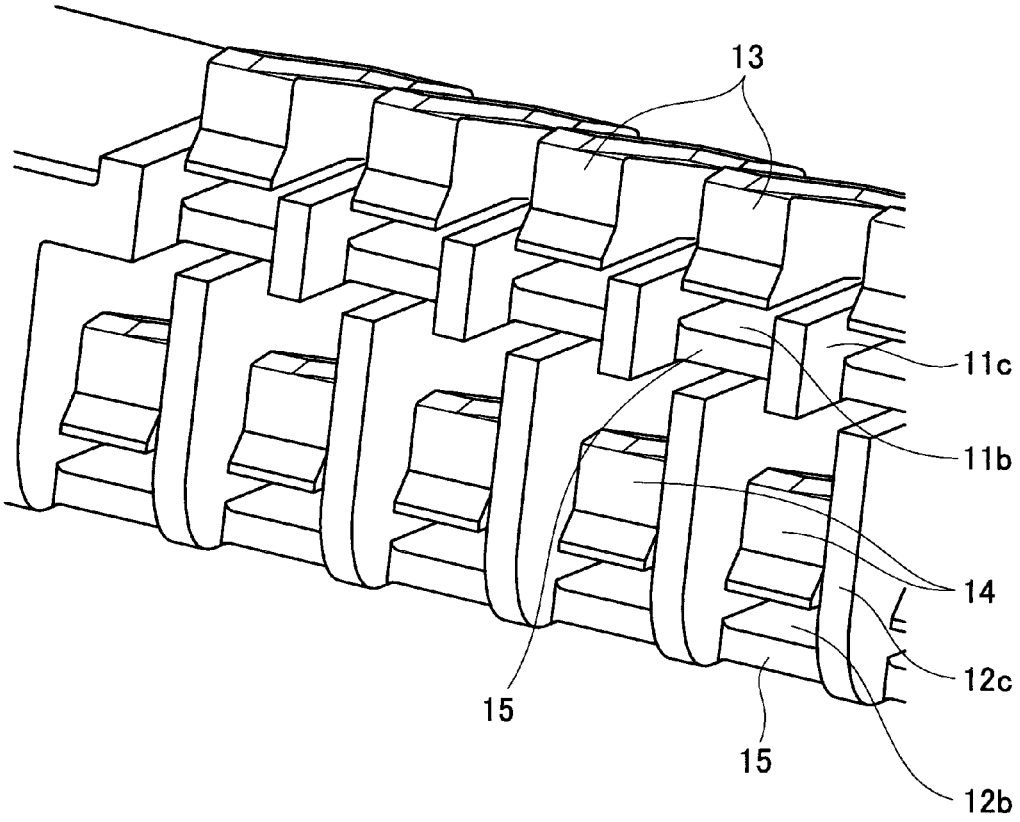
FIG. 3 is an enlarged perspective view of part of a lance block body according to the embodiment of the present invention.
Figure 4:
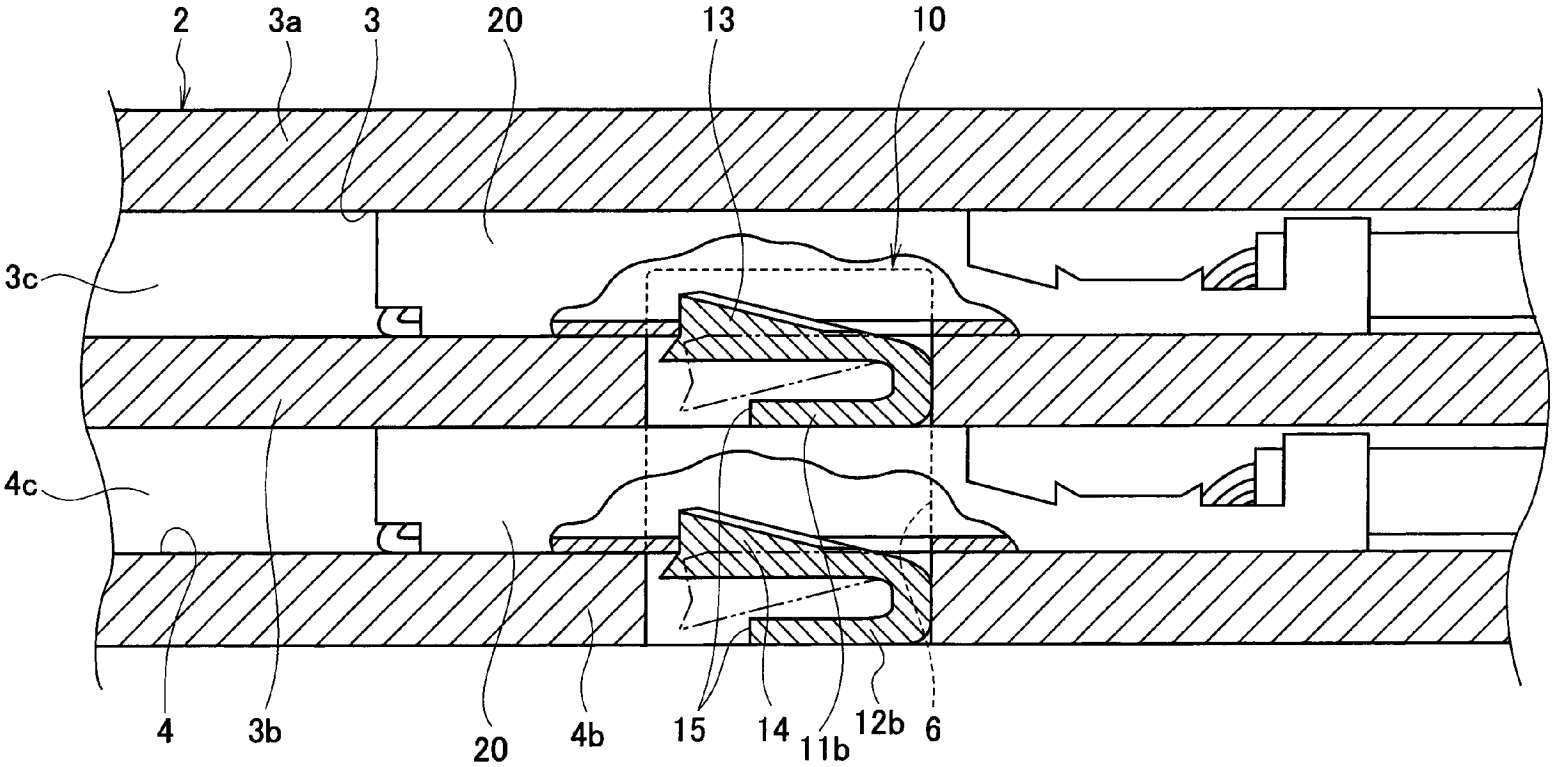
FIG. 4 is a cross-sectional view for explaining flexural deformation of lances in the lance block body according to the embodiment of the present invention.

FIG. 2 to FIG. 4 show an embodiment of the present invention. As shown in FIG. 2 to FIG. 4, a connector 1 includes a connector housing 2, a lance block body 10, and multiple terminals 20. Note that only one terminal 20 is illustrated and the rest of the terminals are omitted in FIG. 2.

The connector housing 2 is provided with multiple terminal housing chambers 3 and multiple terminal housing chambers 4 arranged continuously in a horizontal direction on two upper and lower stages. Each pair of the terminal housing chambers 3 and 4 on the upper and lower stages are separated by a top wall 3*a*, bottom walls 3*b* and 4*b*, and left and right side walls 3*c* and 4*c*. The bottom walls 3*b* of the upper-stage terminal housing chambers 3 also serve as top walls of the lower-stage terminal housing chambers 4. The terminal housing chambers 3 on the upper stage and the corresponding terminal housing chambers 4 on the lower stages are shifted by a ½ pitch in the direction of arrangement thereof.

The connector housing 2 is provided with a lance installation opening 6. The lance installation opening 6 partially cuts out the walls 3*b*, 4*b*, 3*c*, and 4*c* of the terminal housing chambers 3 and 4 on the two upper and lower stages. The lance installation opening 6 is opened to a bottom surface of the connector housing 2.

The lance block body 10 is attached into the lance installation opening 6 of the connector housing 2. The lance block body 10 includes bottom walls 11*b*, side walls 11*c*, bottom walls 12*b*, and side walls 12*c*, which make up for cut-out portions of the bottom walls 3*b*, the bottom walls 4*b*, the side walls 3*c*, and the side walls 4*c* of the terminal housing chambers 3 and 4 on the two upper and lower stages when the land block body 10 is attached into the connector housing 2. The side walls 11*b* also serve as top walls of the lower-stage terminal housing chambers 4.

Meanwhile, the bottom walls 11*b* and 12*b* of the terminal housing chambers 3 and 4 on the upper and lower stages are respectively provided with lances 13 and 14 which project toward the terminal housing chambers 3 and 4 on the upper and lower stages. Each of the lances 13 and 14 is supported in a cantilever fashion by the corresponding bottom wall 11*b* or 12*b*. In other words, the lances 13 and 14 are disposed on the bottom surface sides of the terminal housing chambers 3 and 4 on the upper and lower stages. Cutout portions 15 are respectively provided to the bottom walls 11*b* and 12*b* that support the lances 13 and 14, and at locations in the bottom walls 11*b* and 12*b* corresponding to tracks of the flexural deformation of the lances 13 and 14. The cutout portions 15 avoid interferences of the lances 13 and 14 with the bottom walls 11*b* and 12*b* when the lances 13 and 14 bend in such directions to retreat from the terminal housing chambers 3 and 4. Specifically, since tip end side of each of the lances 13 and 14 is most significantly displaced by the flexural deformation, the cutout portions 15 are provided at locations corresponding to the tip end sides of the lance 13 and 14. Since the terminal housing chambers 3 and 4 on the upper and lower stages are arranged to be shifted to one another, the upper end surfaces of the side walls 12*c* of the lower-stage terminal housing chambers 12*c* are situated below the corresponding cutout portions 15 of the bottom walls 11*b*. The upper-side lances 13 come into contact with the side walls 12*c* and are thereby kept from being flexurally deformed further. In other words, the side walls 12*c* function as walls for preventing the excessive deformation of the lances 13.

In the above-described configuration, when the terminals 20 are inserted into the terminal housing chambers 3 and 4, the lances 13 and 14 bend in the directions to retreat from the terminal housing chambers 3 and 4 as indicated with phantom lines in FIG. 4, thereby allowing insertion of the terminals 20. Here, as indicated with the phantom lines in FIG. 4, the lances 13 and 14 enter the cutout portions 15 of the bottom walls 11*b* and 12*b* and are thus flexurally deformed.

When the terminals 20 are fully inserted into regular insertion positions, the lances 13 and 14 recover from the flexural deformation and are locked to the terminals 20. The terminals 20 are kept from moving in a direction reverse to the insertion direction (a direction to pull out the terminals) by the lances 13 and 14, and are thus positioned.

As described above, the lances 13 and 14 are respectively supported by the walls of the terminal housing chambers 3 and 4 located in the same orientation, i.e., by the bottom walls 11*b* and 12*b*. As a consequence, the orientations of insertion of the terminals 20 into the terminal housing chambers 3 and 4 become the same. Accordingly, the number of procedures for terminal insertion is not increased when the terminal insertion is automated. Regions (spaces) for allowing the flexural deformation of the lances 13 and 14 are secured by providing the bottom walls 11*b* and 12*b* with the cutout portions 15. For this reason, clearances corresponding to the spaces for allowing the flexural deformation of the lances 13 and 14 do not have to be secured between the lances 13 and 14 and the corresponding bottom walls 11*b* and 12*b*. Accordingly, it is possible to reduce the pitch between the terminal housing chambers 3 and 4 vertically and to achieve a reduction in size of the connector 1. Thus, the connector 1 can be downsized without increasing the number of procedures for the terminal insertion.

The terminal housing chambers 3 and 4 on the two upper and lower stages are disposed inside the connector housing 2, and the terminal housing chambers 3 on the upper one of the two upper and lower stages and the corresponding terminal housing chambers 4 on the lower one of the two upper and lower stages are shifted by the ½ pitch in the direction of arrangement thereof. Accordingly, the side walls 12*c* of the lower-stage terminal housing chambers 4 are located below the cutout portions 15 of the bottom walls 11*b*, whereby the side walls 12*c* function as the walls for preventing excessive displacements of the lances 13. Thus, it is possible to prevent the lances 13 from the excessive displacements.

The connector housing 2 is provided with the lance installation opening 6, and the lances 13 and 14 are provided to the lance block body 10 to be attached into lance installation opening 6. The cutout portions 15 need not be provided to the connector housing 2, but only need to be provided to the bottom walls 11*b* and 12*b* of the lance block body 10. As a consequence, it is possible to form the cutout portions 15 easily by injection molding and the like.

In the embodiment, the terminal housing chambers 3 and 4 on the two upper and lower stages are disposed inside the connector housing 2. However, the present invention is also applicable to a configuration to dispose terminal housing chambers on three or more stages vertically.

In the embodiment, the lances 13 and 14 are provided on the bottom walls 11*b* and 12*b*, which are located on the same surface side of the terminal housing chambers 3 and 4. Needless to say, the lances 13 and 14 may be provided to the top walls instead. Meanwhile, the lances 13 and 14 may be provided to the right and left side walls 11*c* and 12*c*.

What is claimed is:

1. A connector comprising:

a connector housing including a plurality of terminal housing chambers on a plurality of stages; and lances each being supported by a wall of the corresponding terminal housing chamber, projecting into the terminal housing chamber, and being configured to bend in a direction to retreat from the terminal housing chamber when a terminal is inserted into the terminal housing chamber and to recover from flexural deformation when the terminal is fully inserted into a regular insertion position;

wherein the lances are supported by the walls of the terminal housing chambers, which are located on the same surface side;

the terminal housing chambers and the lances thereof on one of the stages and the terminal housing chambers and the lances thereof on a stage adjacent to the one of the stages are arranged in such a way as to be shifted from one another; and each of the walls includes a cutout portion configured to avoid interference with the corresponding lance when the lance bends in the direction to retreat from the terminal housing chamber, wherein each pair of the plurality of terminal housing chambers on an upper stage and a lower stage of the plurality of stages are separated by a top wall, bottom walls and left and right side walls, ones of the plurality of terminal housing chambers on the upper stage and ones of the plurality of terminal housing chambers on the lower stage are arranged to be shifted relative to one another such that upper end surfaces of the side walls of the lower-stage terminal housing chambers are situated below the corresponding cutout portions of the bottom walls, and the lances of the upper-stage terminal housing chambers come into contact with the side walls and are thereby kept from being further flexurally deformed such that excessive deformation of the lances is prevented.

2. The connector according to claim 1, wherein the connector housing includes a lance installation opening, and the lances are provided to a lance block body to be attached into the lance installation opening.

3. The connector according to claim 1, wherein the connector housing includes a lance installation opening, and the lance installation opening partially cuts out the walls of the terminal housing chambers on the plurality of stages.

4. The connector according to claim 1, wherein the connector housing includes a lance installation opening, the lance installation opening is opened to a bottom surface of the connector housing.

5. The connector according to claim 1, wherein the plurality of terminal housing chambers are arranged continuously in a horizontal direction on the plurality of stages.

6. The connector according to claim 1, wherein the bottom walls of upper-stage terminal housing chambers also serve as the top walls of lower-stage terminal housing chambers.

7. The connector according to claim 1, wherein the terminal housing chambers on the upper stage and the corresponding terminal housing chambers on the lower stage are shifted by a ½ pitch in the direction of arrangement thereof.

8. The connector according to claim 1, further comprising a lance block body including bottom walls and side walls, which make up for cut-out portions of the bottom walls, and the side walls of the terminal housing chambers on the upper stage and the lower stage and the lance block body is attached into the connector housing.

9. The connector according to claim 1, wherein the lances are provided on the bottom walls of the terminal housing chambers on the upper stage and the lower stage, and the lances project toward the terminal housing chambers on the upper stage and the lower stage, and each of the lances is supported in a cantilever fashion by the corresponding bottom wall.

10. The connector according to claim 9, wherein cutout portions are respectively provided to the bottom walls that support the lances at locations in the bottom walls corresponding to tracks of the flexural deformation of the lances.

11. The connector according to claim 10, wherein the cutout portions avoid interference of the lances with the bottom walls in a condition that the lances bend in such directions to retreat from the terminal housing chambers.

12. The connector according to claim 11, wherein the cutout portions are provided at locations corresponding to tip end sides of the lances in a condition that a tip end side of each of the lances is most significantly displaced by the flexural deformation.

13. The connector according to claim 1, wherein the terminals are fully inserted into regular insertion positions such that the lances recover from the flexural deformation and are locked to the terminals and such that the terminals are kept from moving in a direction reverse to the insertion direction.

14. The connector according to claim 1, wherein the lances are provided on bottom walls on the same surface side of the terminal housing chambers.

15. The connector according to claim 1, wherein the lances are provided on top walls on the same surface side of the terminal housing chambers.

16. The connector according to claim 1, wherein the lances are provided on side walls on the same surface side of the terminal housing chambers.

17. The connector according to claim 16, wherein the lances are provided on right side walls on the same surface side of the terminal housing chambers.

18. The connector according to claim 16, wherein the lances are provided on left side walls on the same surface side of the terminal housing chambers.

* * * * *